US006170602B1

(12) United States Patent
Mann

(10) Patent No.: US 6,170,602 B1
(45) Date of Patent: Jan. 9, 2001

(54) SOUND EMITTING AND VIBRATABLE BLANKET

(76) Inventor: Evelyn Kay Mann, 2760 Anderson Hwy., Powhatan, VA (US) 23139

( * ) Notice: Under 35 U.S.C. 154(b), the term of this patent shall be extended for 0 days.

(21) Appl. No.: 09/574,527

(22) Filed: May 19, 2000

(51) Int. Cl.[7] ..... A47D 9/02; G10K 7/00

(52) U.S. Cl. ..... 181/141; 600/26

(58) Field of Search ..... 181/141, 142; 600/26, 27, 28

(56) References Cited

U.S. PATENT DOCUMENTS 4,507,816 * 4/1985 Smith, Jr. ..... 181/141

5,063,912 * 11/1991 Hughes ..... 600/26

* cited by examiner

*Primary Examiner*—Khanh Dang

(57) ABSTRACT

A sound emitting and vibratable blanket for providing comfort to the baby or infant. The sound emitting and vibratable blanket includes a quilt member having a central portion, end portions, and a top side, and further having outer layers with padding being sandwiched therebetween; and also includes a conventional sound producing member securely disposed in an end portion of the quilt member and having a first switch visibly and securely disposed upon the quilt member for energizing said sound producing member; and further includes a vibrating mechanism securely disposed at the central portion of the quilt member inside the padding thereof for vibrating the quilt member and having a second switch visibly and securely disposed upon the quilt member for energizing said vibrating mechanism.

10 Claims, 1 Drawing Sheet

SOUND EMITTING AND VIBRATABLE BLANKET

BACKGROUND OF THE INVENTION

1. Field of the Invention

The present invention relates to a baby or infant soothing blanket and more particularly pertains to a new sound emitting and vibratable blanket for providing comfort to the baby or infant.

2. Description of the Prior Art

The use of a baby or infant soothing blanket is known in the prior art. More specifically, a baby or infant soothing blanket heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,681,096; U.S. Pat. No. 5,784,733; U.S. Pat. No. 4,947,832; U.S. Pat. No. 5,014,376; U.S. Pat. No. 4,972,533; and U.S. Pat. No. Des. 361,686.

While these devices fulfill their respective, particular objectives and requirements, the aforementioned patents do not disclose a new sound emitting and vibratable blanket. The inventive device includes a quilt member having a central portion, end portions, and a top side, and further having outer layers with padding being sandwiched therebetween; and also includes a conventional sound producing member securely disposed in an end portion of the quilt member and having a first switch visibly and securely disposed upon the quilt member for energizing said sound producing member: and further includes a vibrating mechanism securely disposed at the central portion of the quilt member inside the padding thereof for vibrating the quilt member and having a second switch visibly and securely disposed upon the quilt member for energizing said vibrating mechanism.

In these respects, the sound emitting and vibratable blanket according to the present invention substantially departs from the conventional concepts and designs of the prior art, and in so doing provides an apparatus primarily developed for the purpose of providing comfort to the baby or infant.

SUMMARY OF THE INVENTION

In view of the foregoing disadvantages inherent in the known types of baby or infant soothing blanket now present in the prior art, the present invention provides a new sound emitting and vibratable blanket construction wherein the same can be utilized for providing comfort to the baby or infant.

The general purpose of the present invention, which will be described subsequently in greater detail, is to provide a new sound emitting and vibratable blanket which has many of the advantages of the baby or infant soothing blanket mentioned heretofore and many novel features that result in a new sound emitting and vibratable blanket which is not anticipated, rendered obvious, suggested, or even implied by any of the prior art baby or infant soothing blanket, either alone or in any combination thereof.

To attain this, the present invention generally comprises a quilt member having a central portion, end portions, and a top side, and further having outer layers with padding being sandwiched therebetween; and also includes a conventional sound producing member securely disposed in an end portion of the quilt member and having a first switch visibly and securely disposed upon the quilt member for energizing said sound producing member; and further includes a vibrating mechanism securely disposed at the central portion of the quilt member inside the padding thereof for vibrating the quilt member and having a second switch visibly and securely disposed upon the quilt member for energizing said vibrating mechanism.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sound emitting and vibratable blanket which has many of the advantages of the baby or infant soothing blanket mentioned heretofore and many novel features that result in a new sound emitting and vibratable blanket which is not anticipated, rendered obvious. suggested, or even implied by any of the prior art baby or infant soothing blanket, either alone or in any combination thereof.

It is another object of the present invention to provide a new sound emitting and vibratable blanket which may be easily and efficiently manufactured and marketed.

It is a further object of the present invention to provide a new sound emitting and vibratable blanket which is of a durable and reliable construction.

An even further object of the present invention is to provide a new sound emitting and vibratable blanket which is susceptible of a low cost of manufacture with regard to both materials and labor, and which accordingly is then susceptible of low prices of sale to the consuming public, thereby making such sound emitting and vibratable blanket economically available to the buying public.

Still yet another object of the present invention is to provide a new sound emitting and vibratable blanket which provides in the apparatuses and methods of the prior art some of the advantages thereof, while simultaneously overcoming some of the disadvantages normally associated therewith.

Still another object of the present invention is to provide a new sound emitting and vibratable blanket for providing comfort to the baby or infant.

Yet another object of the present invention is to provide a new sound emitting and vibratable blanket which includes a quilt member having a central portion, end portions, and a top side, and further having outer layers with padding being sandwiched therebetween; and also includes a conventional sound producing member securely disposed in an end portion of the quilt member and having a first switch visibly and securely disposed upon the quilt member for energizing said sound producing member; and further includes a vibrating mechanism securely disposed at the central portion of the quilt member inside the padding thereof for vibrating the quilt member and having a second switch visibly and securely disposed upon the quilt member for energizing said vibrating mechanism.

Still yet another object of the present invention is to provide a new sound emitting and vibratable blanket that soothes and calms the child.

Even still another object of the present invention is to provide a new sound emitting and vibratable blanket that essentially pats the child while the child is lying beneath the blanket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
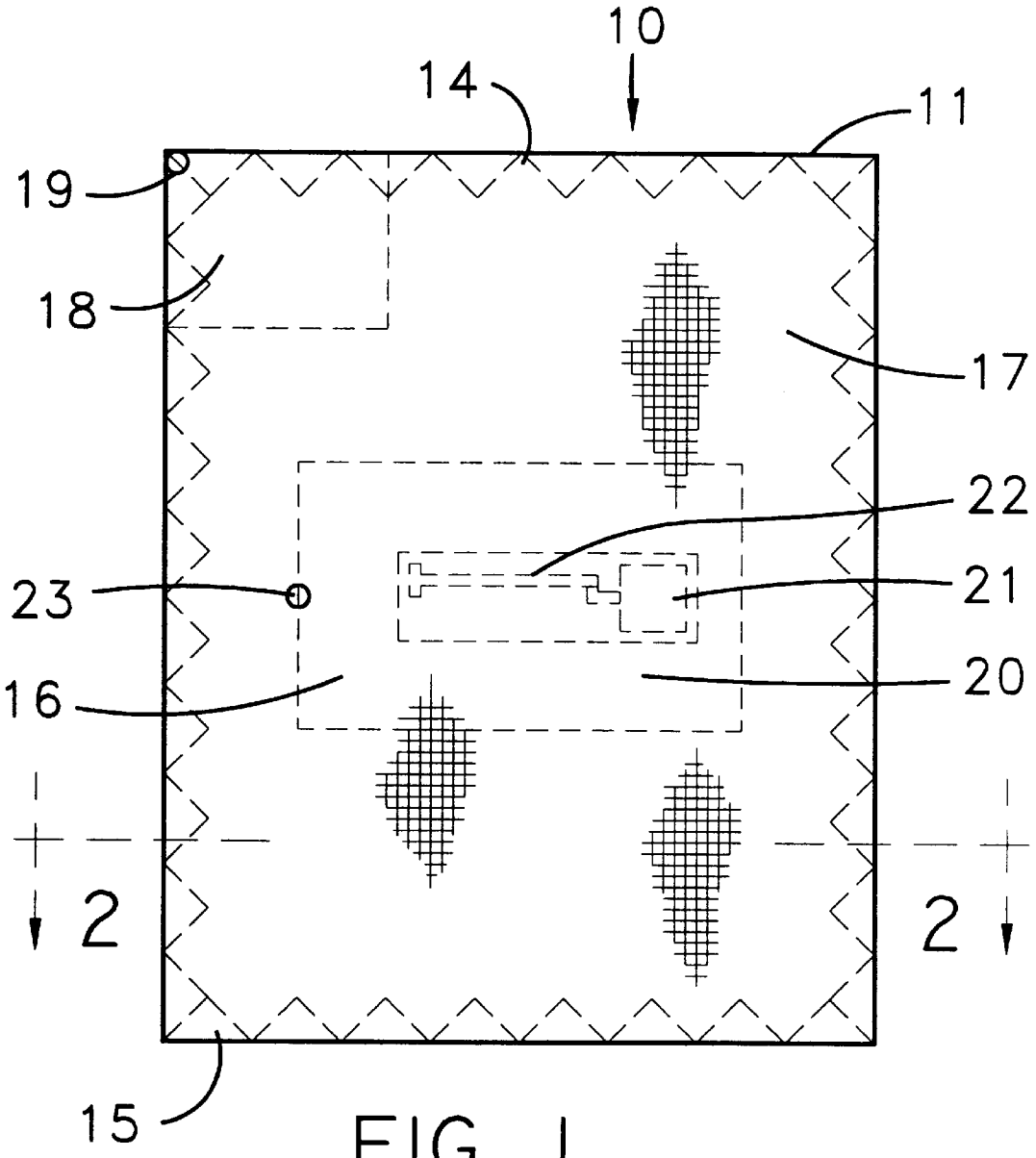
FIG. 1 is a top plan view of a new sound emitting and vibratable blanket according to the present invention.
Figure 2:
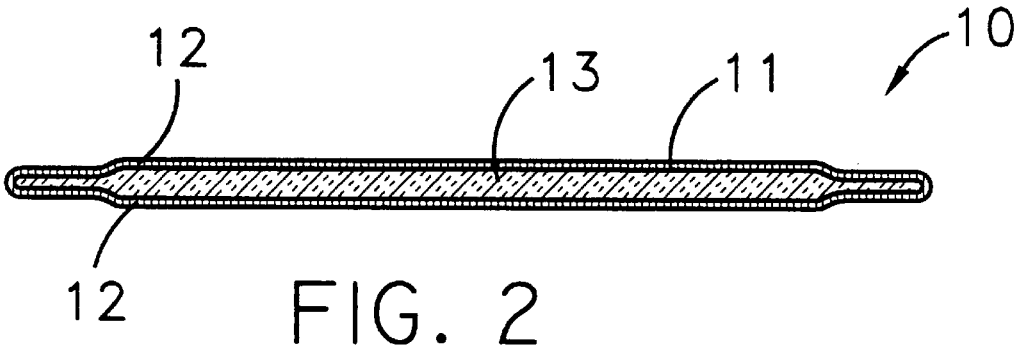
FIG. 2 is a cross-sectional view of the present invention.

With reference now to the drawings, and in particular to FIGS. 1 through 2 thereof, a new sound emitting and vibratable blanket embodying the principles and concepts of the present invention and generally designated by the reference numeral 10 will be described.

As best illustrated in FIGS. 1 through 2, the sound emitting and vibratable blanket 10 generally comprises a quilt member 11 having a central portion 16, end portions 14,15, and a top side 17, and further having outer layers 12 with padding 13 being securely and conventionally sandwiched therebetween. The outer layers 12 include a material made of a continuous, tough, and elastic fiber which is essentially silk with the quilt member 11 being essentially rectangular and having a dimensions of approximately 21 inches by 36 inches. A sound producing member 18 such as a tape player or a music box is securely conventionally disposed in one of the end portions 14 of the quilt member 11 and has a first switch 19 visibly, securely, and conventionally disposed upon the top side 17 of the quilt member 11 for energizing the sound producing member 18 with the sound producing member 18 being essentially disposed in a corner of one of the end portions 14 of the quilt member 11 inside the padding 13. A vibrating mechanism 20 is securely and conventionally disposed at the central portion 16 of the quilt member 11 inside the padding 13 thereof for vibrating the quilt member 11 and having a second switch 23 visibly, securely, and conventionally disposed upon the quilt member 11 for energizing the vibrating mechanism 20. The vibrating mechanism 20 includes a motor 21 having an unbalanced shaft 22 and being connected to the second switch 23.

In use, the blanket 10 is to be used primarily for babies and infants with the quilt member 11 being laid upon the baby or infant and the tape player or music box being turned on to provide music for the baby or infant and the vibrating mechanism 20 being turned on to essentially vibrate upon the baby or infant in a similar fashion as if someone was patting the baby or infant.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sound emitting and vibratable blanket comprising:

a quilt member having a central portion, end portions, and a top side, and further having outer layers with padding being sandwiched therebetween;

a sound producing member securely disposed in one of said end portions of said quilt member and having a first switch visibly and securely disposed upon said quilt member for energizing said sound producing member; and a vibrating mechanism securely disposed at said central portion of said quilt member inside said padding thereof for vibrating said quilt member and having a second switch visibly and securely disposed upon said quilt member for energizing said vibrating mechanism.

2. A sound emitting and vibratable blanket as described in claim 1, wherein said outer layers include a material made of a continuous, tough, and elastic fiber.

3. A sound emitting and vibratable blanket as described in claim 2, wherein said continuous, tough, and elastic fiber is essentially silk.

4. A sound emitting and vibratable blanket as described in claim 3, wherein said sound producing member is essentially disposed in a corner of one of said end portions of said quilt member inside said padding.

5. A sound emitting and vibratable blanket as described in claim 4, wherein said vibrating mechanism includes a motor having an unbalanced shaft and being connected to said second switch.

6. A sound emitting and vibratable blanket as described in claim 5, wherein said sound producing member is essentially a tape player.

7. A sound emitting and vibratable blanket as described in claim 5, wherein said sound producing member is essentially a music box.

8. A sound emitting and vibratable blanket comprising:

a quilt member having a central portion, end portions, and a top side, and further having outer layers with padding being sandwiched therebetween, said outer layers including a material made of a continuous, tough, and elastic fiber which is essentially silk, said quilt member being essentially rectangular and having a dimensions of approximately 21 inches by 36 inches;

a sound producing member securely disposed in one of said end portions of said quilt member and having a first switch visibly and securely disposed upon said quilt member for energizing said sound producing member, said sound producing member being essentially disposed in a corner of one of said end portions of said quilt member inside said padding; and a vibrating mechanism securely disposed at said central portion of said quilt member inside said padding thereof for vibrating said quilt member and having a second switch visibly and securely disposed upon said quilt member for energizing said vibrating mechanism, said vibrating mechanism including a motor having an unbalanced shaft and being connected to said second switch.

9. A sound emitting and vibratable blanket as described in claim 8, wherein said sound producing member is essentially a tape player.

10. A sound emitting and vibratable blanket as described in claim 9, wherein said sound producing member is essentially a music box.

* * * * *